US007314029B2

(12) United States Patent
Hiraiwa

(10) Patent No.: US 7,314,029 B2
(45) Date of Patent: Jan. 1, 2008

(54) VARIABLE VALVE TIMING DEVICE ADAPTED FOR INTERNAL COMBUSTION ENGINE

(76) Inventor: Kazuyoshi Hiraiwa, 6-5-8 Tomioka-nishi Kanazawa-ku, Yokohama (JP) 236-0052

( * ) Notice: Subject to any disclaimer, the term of this patent is extended or adjusted under 35 U.S.C. 154(b) by 0 days.

(21) Appl. No.: 11/602,327

(22) Filed: Nov. 21, 2006

(65) Prior Publication Data

US 2007/0119401 A1 May 31, 2007

(30) Foreign Application Priority Data

Nov. 28, 2005 (JP) ..... 2005-341370

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.27, 90.31, 90.39, 90.44, 90.6; 74/559, 567, 569

See application file for complete search history.

(56) References Cited

U.S. PATENT DOCUMENTS 6,907,852 B2 * 6/2005 Schleusener et al. .... 123/90.16
7,240,649 B2 * 7/2007 Hara et al. ..... 123/90.16

FOREIGN PATENT DOCUMENTS

JP 11-107725 4/1999

* cited by examiner

*Primary Examiner*—Ching Chang
(74) *Attorney, Agent, or Firm*—Wenderoth, Lind & Ponack, L.L.P.

(57) ABSTRACT

A variable valve timing device, adapted for an internal combustion engine, includes a cam shaft having a first cam surface, a rocker arm rotatably supporting a first roller and enabling a valve to be opened by its swing movement when the first roller is pressed, a drive link rotatably supporting a second roller and moving to drive a connecting pin when the second roller is pressed by the first cam surface, a swing cam having a second cam surface and being swingable at a center of a stationary support shaft, when it is pressed by the drive link through the connecting pin, so that the second cam surface presses the first roller, and an actuator for changing a position of a third cam surface to vary a position of the drive link.

15 Claims, 7 Drawing Sheets

VARIABLE VALVE TIMING DEVICE ADAPTED FOR INTERNAL COMBUSTION ENGINE

BACKGROUND OF THE INVENTION

1. Field of the Invention

The present invention relates to a variable valve timing device that is adaptable for an internal combustion engine and can continuously change open/close timing and a peak lift amount of an intake valve and/or an exhaust valve according to an operating state of an internal combustion engine installed on a motor vehicle.

2. Description of the Related Art

A conventional variable valve timing device of this kind is disclosed in Japanese patent laid-open publication No. (Tokkaihei) 11-107725. This conventional variable valve timing device includes a rocker-arm arranged between a drive cam and a swing cam so that the drive cam can drive the swing cam to be swung, where a position of a swing center of the rocker-arm can be changed by a control cam which swingably supports the swing cam at its swing center.

Another conventional variable timing device of this kind is disclosed in Japanese patent laid-open publication (Translation of PCT Application) No. (Tokkyokohyo) 2004-521234. In this conventional variable valve timing device, lift movement of a valve is controlled via a transmitting element by using a control track provided at a one end portion of a swing lever driven by a camshaft of an engine. The other end portion of the swing lever has a swing center point whose position is changeable by using an adjustment device.

The above known conventional variable valve timing devices, however, encounter a problem in that timing, corresponding to rotational phase of the cam shaft, when a valve-lift amount reaches a peak, hardly varies, although a valve-open range, corresponding to a rotational angle of a cam shaft between a valve-open angle and a valve-close angle, and a peak valve-lift amount can be continuously variable.

This causes delay of valve-open timing when the peak lift amount of the valve is set to be smaller. If the device is adapted for an intake valve, too long period causes between exhaust-valve-close timing and intake-valve-open timing.

In order to remove the above-mentioned problem, a timing adjusting device may be added to the variable valve timing device so as to advance the valve-open timing as the peak lift amount becomes smaller. Such the timing adjustment device is constructed to change a rotational phase between a cam shaft and a sprocket driving the cam shaft for example. Consequently, the peak lift amount and the timing are controlled at the same time, which encounters a problem in that the variable valve timing device with the timing adjustment device becomes complex, increasing its weight and manufacturing costs.

It is, therefore, an object of the present invention to provide a variable valve timing device, adapted for an internal combustion engine, which overcomes the foregoing drawbacks and can widely vary timing of a peak-lift position of a valve according to a peak lift amount of the valve and a change of valve-open region without an additional special timing adjusting device.

SUMMARY OF THE INVENTION

According to a first aspect of the present invention there is provided a variable valve timing device, adapted for an internal combustion engine, which includes a first roller, a second roller, a connecting pin, a support shaft, a cam shaft, a rocker arm, a drive link, a swing cam, and an actuator.

The support shaft is provided on a stationary member, and the cam shaft is formed thereon with a first cam surface. The rocker arm rotatably supports the first roller and enabling a valve to be opened by a swing movement of the rocker arm when the first roller is pressed. The drive link rotatably supports the second roller and moving to drive the connecting pin when the second roller is pressed by the first cam surface. The swing cam is formed thereon with a second cam surface, and is swingable at a center of the support shaft, when the swing cam is pressed by the drive link through the connecting pin, so that the second cam surface presses the first roller. The control actuator changes a position of a third cam surface to vary a position of the drive link.

Therefore, the variable valve timing device can widely vary timing of a peak-lift position of a valve according to a peak lift amount of the valve and a change of valve-open region without an additional special timing adjusting device.

Preferably, a contact position between the second roller and the first cam surface of the cam shaft moves in a direction opposite to a rotational direction of the cam shaft when the third cam surface is moved in a direction where a maximum lift amount of the valve becomes smaller.

This can advance the valve timing as the peak lift amount becomes smaller. Therefore, it can provide a desirable valve-open characteristic of the internal combustion engine.

Preferably, the drive link rotatably supports the third roller, and the third roller is in contact with the third cam surface.

Therefore, main parts of the device can be manufactured easily and at low costs.

Preferably, the third cam surface is formed to have a circular-arc surface.

Therefore, the cam surface can be formed at easily and at low costs, obtaining a desirable valve-open characteristic.

Preferably, the third cam surface is provided with the control shaft.

Therefore, the device can be simply constructed, thereby decreasing its weight and manufacturing costs.

Preferably, the third cam surface is formed on the control cam which is arranged between the drive link and the control shaft and is movable by the control shaft.

Therefore, the device can be simply constructed and the control shaft can be driven by smaller torque, thereby decreasing its weight and manufacturing costs.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
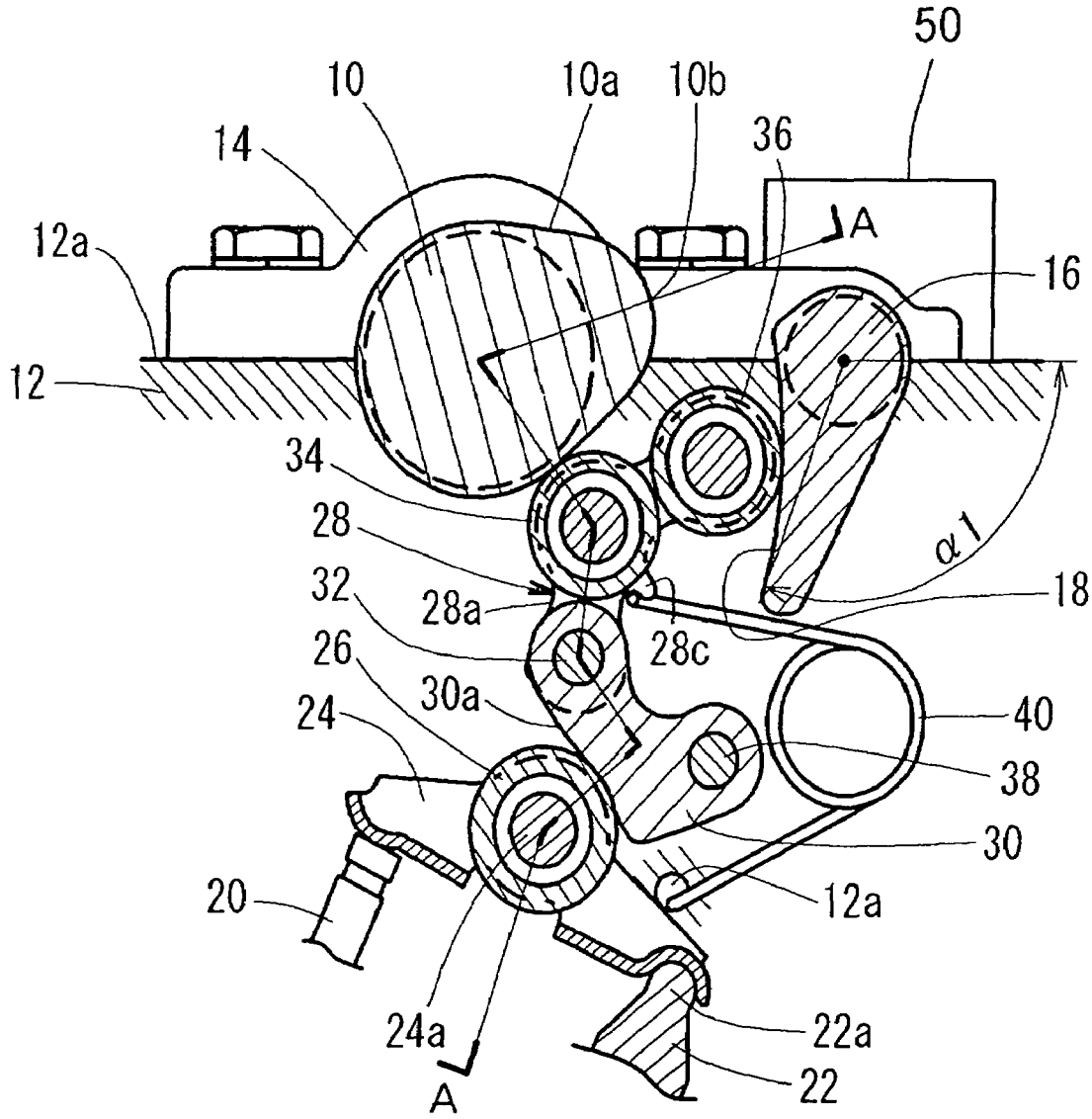
FIG. 1 is a cross-sectional view, taken along a line C-C in FIG. 2, showing a variable valve timing device of a first embodiment according to the present invention, the device being adapted to an intake valve of an internal combustion engine for a motor vehicle.

Throughout the following detailed description, similar reference characters and numbers refer to similar elements in all figures of the drawings, and their descriptions are omitted for eliminating duplication.

Figure 2:
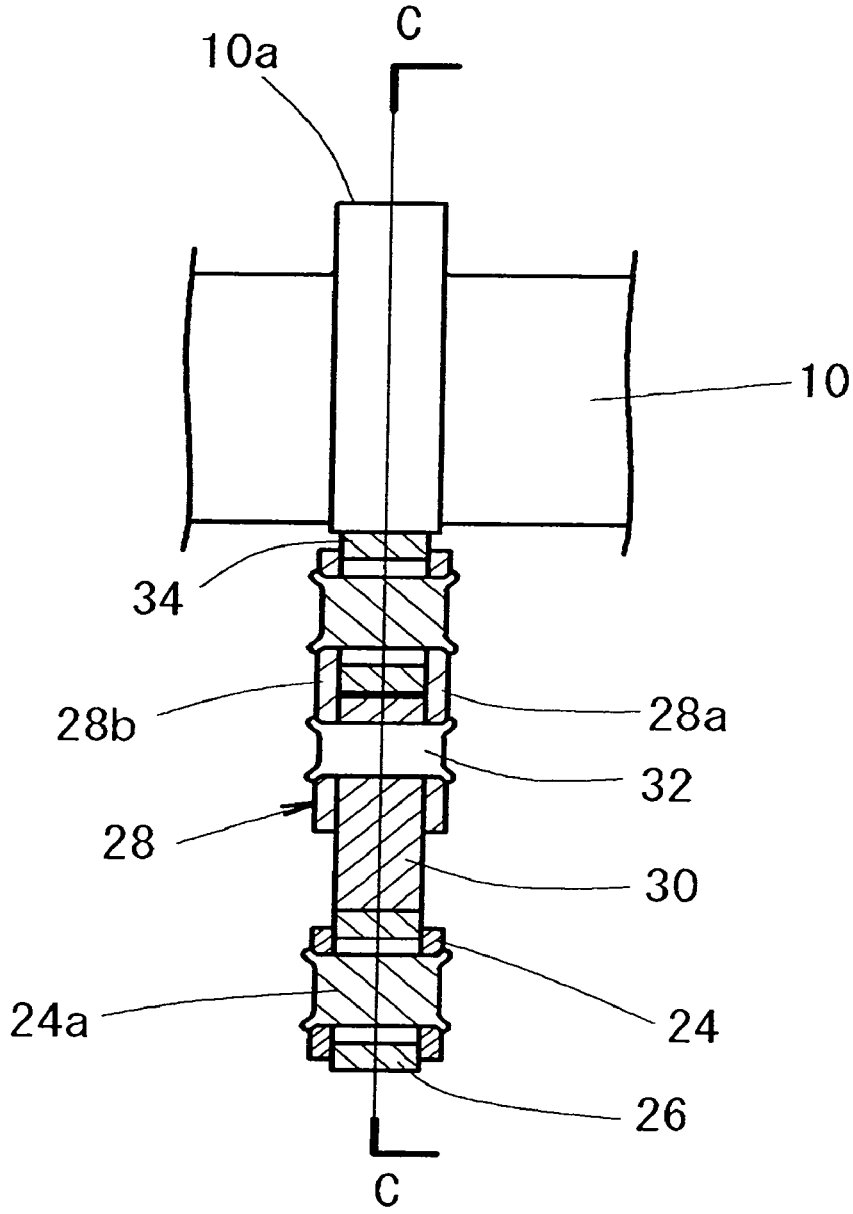
FIG. 2 is a development elevation taken along a line A-A in FIG. 1.

Referring to FIG. 1 and FIG. 2, there is shown a first preferred embodiment of a variable valve timing device according to the present invention.

A cam shaft 10 is rotatably supported by and between a cylinder head 12 of a not-shown internal combustion engine and a bracket 14 attached to a stationary surface 12*a* of the cylinder head 13 so that the cam shaft 12 is driven to rotate by a not-shown crank shaft of the engine. The cylinder head 12 corresponds to a stationary member of the present invention.

The cam shaft 10 has a first cam surface 10*a*, which is formed to have a profile with a top portion 10*b* similarly to that of conventional internal combustion engines.

A control shaft 16 is supported by and between the stationary surface 12*a* of the cylinder head 12 and the bracket 14, and is driven by an actuator 50 to rotate. The control shaft 16 has an extension portion formed with a third cam surface 18, which is in a circular-arc shape in cross-section, being shaped like a part of an inner surface of an circular cylinder as shown in FIG. 1.

A rocker arm 24 is provided between an intake valve 20 and a lash adjuster 22, both provided on the cylinder head 12. Incidentally, the intake valve 20 and the lash adjuster 22, which are partially illustrated in FIG. 1, have constructions and configurations similar to those of conventional ones.

A first roller 26 is rotatably supported on the rocker arm 24. There is provided with a not-shown bearing between the first roller 26 and a pin 24*a* integrally formed with the rocker arm 24.

The lash adjuster 22 is fixed on the cylinder head 12, and is formed at its top portion with a ball portion 22*a*, which acts as a swing supporting point. The rocker arm 24 can swing at the center of the ball portion 22*a*. When it swings in a counterclockwise direction, the intake valve 20 is moved from a state shown in FIG. 1 in a diagonally downward left direction in FIG. 1 so as to open the intake valve 20 in proportional to its swing angle.

The intake valve 20 is urged toward a diagonally upward right direction in FIG. 1 by elastic force of a not-shown spring, so that the intake valve 20 is moved to a position shown in FIG. 1 to close when the rocker arm 24 does not press it.

A drive link 28 and a swing cam 30 are arranged between the cam shaft 10 and the rocker arm 24. The drive link 28 and the swing cam 30 are connected with each other so that they can swing relative to each other. The drive link 28 consists of two plates 28*a* and 28*b* as shown in FIG. 2, and rotatably supports a second roller 34 and a third roller 36 arranged between the plates 28*a* and 28*b*. Inside of each of the second roller 34 and the third roller 36, there is provided with a not-shown bearing.

The second roller 34 contacts with the first cam surface 10*a* of the cam shaft 10, and the third roller 36 contacts with the third cam surface 18 of the control shaft 16.

Figure 7:
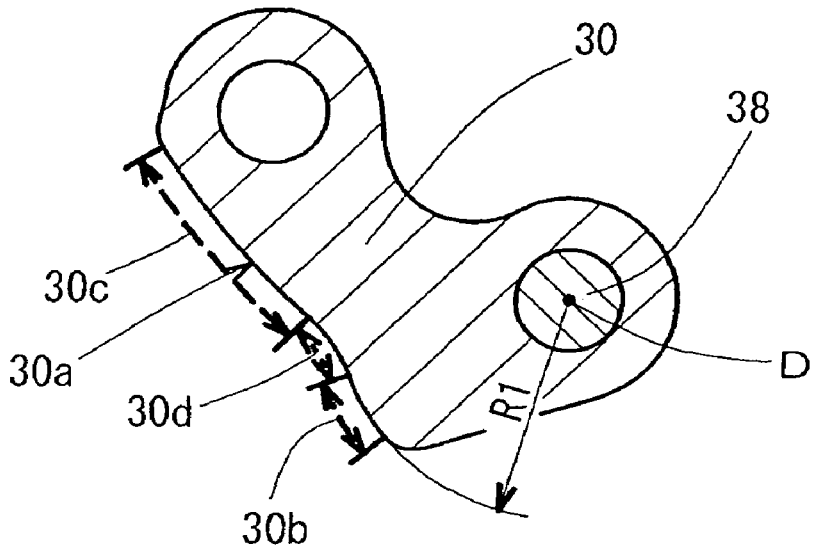
FIG. 7 is an enlarged cross-sectional view of a swing cam used in the variable valve timing device shown in FIG. 6.

The swing cam 30 is swingable at the center of a support shaft 38 fixed on the cylinder head 12, and is formed thereon with a second cam surface 30*a* which contacts with the first roller 26. As shown in FIG. 7, the second cam surface 30*a* includes a base curved portion 30*b*, a valve-open curved portion 30*c* and a ramp portion 30*d* connecting them. The base curved portion 30*b* is formed by a circular arc surface having a radius R1 from the center D of the support shaft 38. The base curved portion 30*b* is set to close the intake valve 20 when the first roller 26 contacts with the base curved portion 30*b*, which will be later described in detail.

The drive link 28 is formed with a hook portion 28*c* projecting from its outer surface outwardly. The drive link 28 is always pushed upward in FIG. 1 by elastic force caused by a spring 40, which is arranged so that its one end portion of the spring 40 contacts with the hook portion 28*c* of the drive link 28 and its other end portion is inserted in and fixed to a hole portion 12*b* of the cylinder head 12.

This enables the drive link 28 to be kept at a position and in a state where the second roller 34 always contacts with both of the first cam surface 10*a* of the cam shaft 10 and the third cam surface 18 of the control shaft 16. Accordingly, a position, or a swing angle, of the swing cam 30 connected with the drive link 28 depends on a position of the drive link 28.

The operation of the variable valve timing device of the first embodiment will be described with reference to the accompanying drawings of FIGS. 3 to 5.

In the following description, the function of the variable timing valve of the present invention will be described, in some cases, with separating it into a "variable lift-amount" function and a "variable timing" function. In the former function a peak-lift-amount of the intake valve 20 varies, while in the latter function timing(s) of valve-open and/or valve-close varies (vary). Positions, or rotational phases, in a rotational direction of the cam shaft 10 and the control shaft 16 are respectively measured relative to the fixed surface 12*a* of the cylinder head 12 as a base surface.

FIG. 1 shows a state where the control shaft 16 is located at an angle of □1 relative to the fixed surface 12*a*, that is, a position where it is rotated the largest amount in a clockwise direction. The first cam surface 10*a* shown in FIG. 1 is illustrated in a state where the drive link 28 is located at a position where it is started to move when the cam shaft 10 rotates in the clockwise direction in FIG. 1.

In this state, the first roller 26 contacts with the base curved portion 30*b* of the swing cam 30 to close the intake valve 20. The cam shaft 10 rotates from this state in the clockwise direction, and consequently the first cam surface 10*a* of the cam shaft 10 gradually presses the second roller 34. This press causes the drive link 28 to be moved downward in FIG. 1 by the third roller 36 moving along the third cam surface 18 of the control shaft 16. The swing cam 30 swings at the center of the support shaft 38 in the counterclockwise direction in FIG. 1 so that the ramp portion 30*d* of the swing cam 30 presses the first roller 26 downward. Then, the valve-open curved portion 30*c* of the swing cam 30 starts to press the first roller 26 downward.

This downward movement of the first roller 26 brings the rocker arm 24 to be swung at the center of the ball portion 22*a* of the lash adjuster 22 in the counterclockwise direction, and thereby the intake valve 20 is pressed in the diagonally downward left direction to open. The moving amount of the intake valve 20 in this period corresponds to a lift amount of the intake valve 20.

Figure 3:
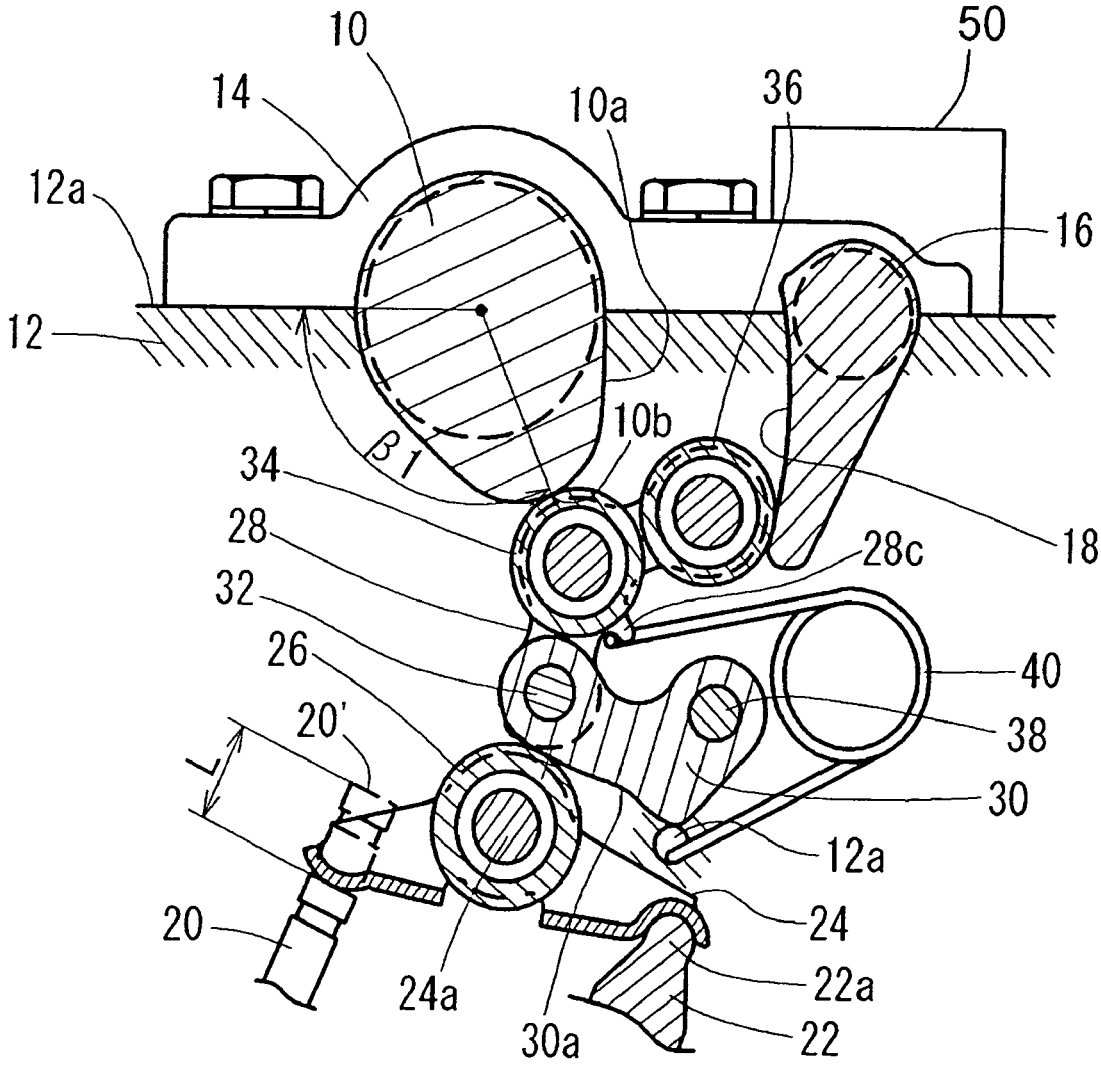
FIG. 3 is a cross-sectional view showing an operating state of the variable valve timing device shown in FIG. 1 when a rotational phase of a control shaft is an angle ◘1.

FIG. 3 shows a state where the cam shaft 10 further rotates in the clockwise direction so that the top portion 10*b* of the first cam surface 10*a* contacts with the first roller 26, and consequently the drive link 28 is moved to the downwardmost position. In this state, the swing cam 30 is swung to the largest-swing-angle position in the counterclockwise direction, where the intake valve 20 opens to provide the maximum opening area, that is, it is located at the maximum lift position.

The lift amount of this time is the maximum downward-moving amount, indicated by L, from a position of the intake valve 20', which is located at a closed state position and illustrated by a broken line. This state, where the top potion 10*b* of the first cam surface 10*a* contacts with the first roller 26 and its lift amount becomes the maximum amount L, is referred as a peak lift.

The cam shaft 10 further rotates in the clockwise direction from the state shown in FIG. 3, and consequently the swing cam 30 starts to reverse its swing direction, so that the swing cam 30 moves in the clockwise direction so as to return to the state shown in FIG. 1. This decreases the lift amount of the intake valve 20 to close the intake valve 20 as shown in FIG. 1. Specifically, the rotation, in the clockwise direction, of the cam shaft 10 enables the swing cam 30 to swing between the state shown in FIG. 1 and the state shown in FIG. 3. This forces the intake valve 20 to move between the state shown in FIG. 1 and the state shown in FIG. 3, repeating to open and close.

Incidentally, when the control shaft 16 is located at a position, shown in FIGS. 1 and 3, of an angle of ◘1 shown in FIG. 1, the intake valve 20 is controllable so that the peak lift amount of the variable lift becomes the maximum lift amount. On the other hand, the rotational phase of the cam shaft 10 at the peak lift, as shown in FIG. 3, is at a position of an angle of ◘1, located between the stationary surface 12*a* and the top portion 10*b* of the first cam surface 10*a*.

Next, the variable lift control for decreasing the peak lift amount will be described.

Figure 4:
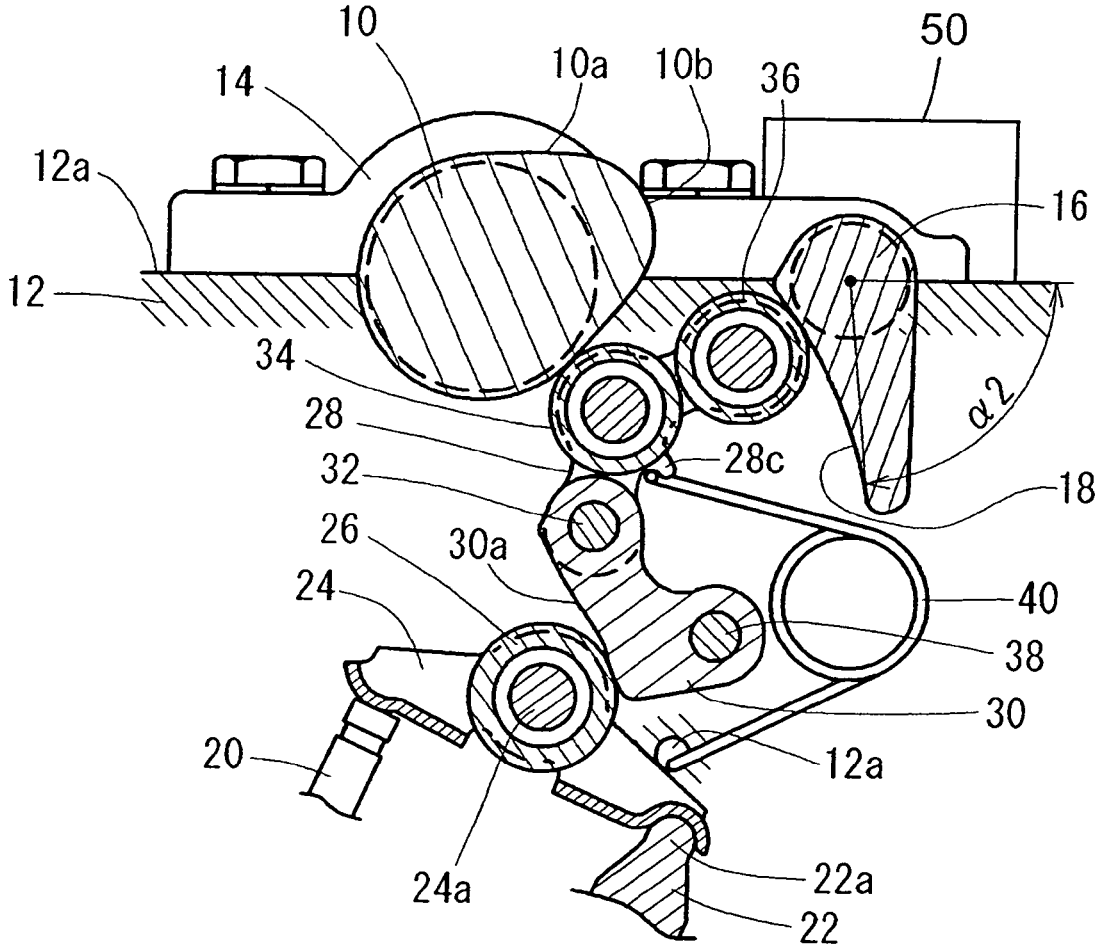
FIG. 4 is a cross-sectional view showing another operating state of the variable valve timing device shown in FIG. 1 when the rotational phase is an angle ◘2.
Figure 5:
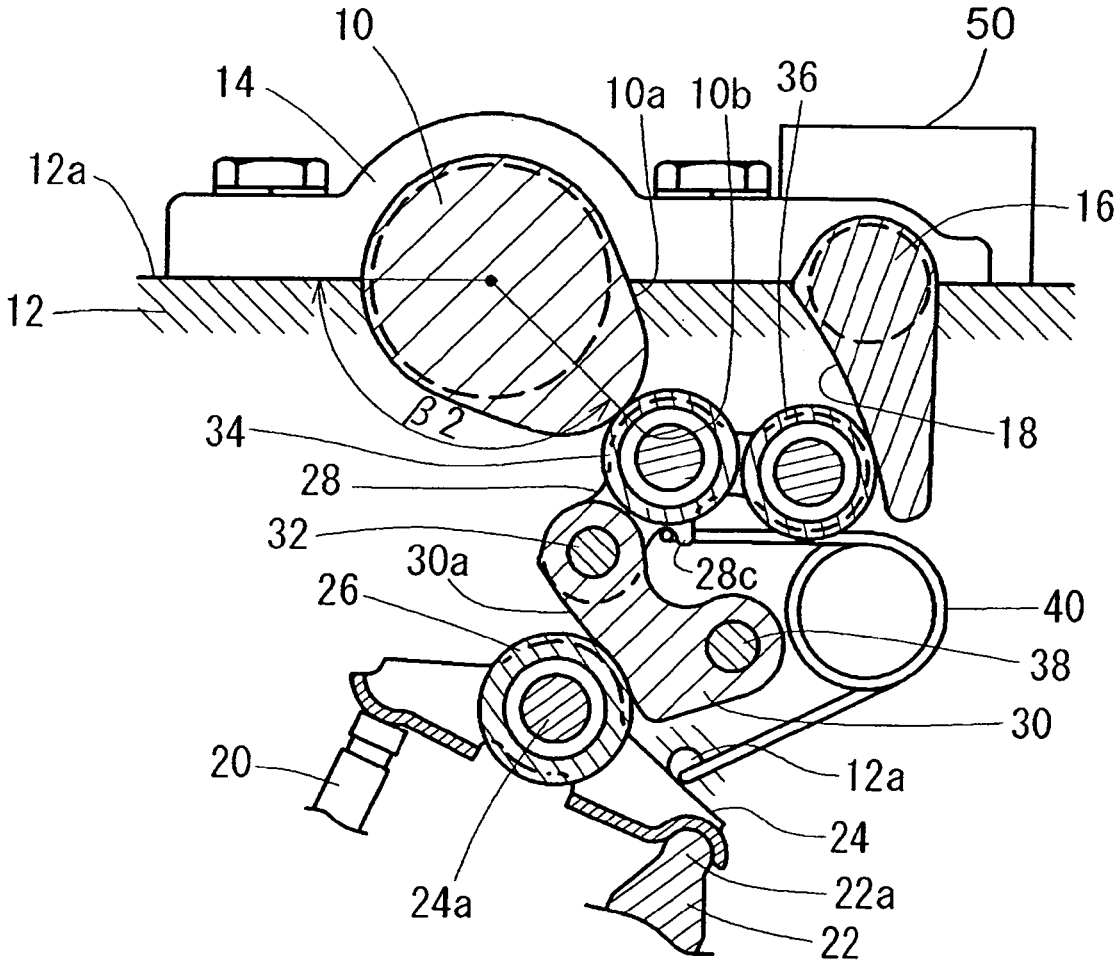
FIG. 5 is a cross-sectional view showing other operating state of the variable valve timing device when the rotational phase is an angle □2 and a cam shaft further rotates from a state shown in FIG. 4.

The control shaft 16 is rotated from the state shown in FIGS. 1 and 3 in the counterclockwise direction, which causes the state of the drive link 28 to gradually approach the state shown in FIGS. 4 and 5. When the third cam surface 18 moves to the position (at an angle ◘2 in FIG. 4) shown in FIGS. 4 and 5, the intake valve 20 is controllable so that the peak lift amount of the variable lift becomes the minimum lift amount. Specifically, the state shown in FIG. 4 corresponds to the state shown in FIG. 1 in that the drive link 28 starts to move when the cam shaft 10 is rotated in the clockwise direction, although the third cam surface 18 of the control shaft 16 is located at a rotational phase of the angle ◘2 in FIG. 4, where it is rotated at the maximum amount in the counterclockwise direction. In this state, the first roller 26 contacts with the base curved portion 30*b* of the swing cam 30, thereby the intake valve 20 being closed similarly to that in FIG. 1.

The cam shaft 10 is further rotated from this state in the clockwise direction, and consequently the first cam surface 10*a* thereof gradually presses the second roller 34. This causes the drive link 28 to be moved downward by the third roller 36 moving along the third surface 18 of the control shaft 16, thereby the swing cam 30 being swung at the center of the support shaft 38 in the counterclockwise direction. A contact point between the second cam surface 30*a* and the first roller 26 is kept being on the base curved portion 30*b* to close the intake valve 20, even at a peak lift position where the top portion 10*b* of the first cam surface 10*a* contacts with the second roller 34 as shown in FIG. 5.

That is, when the third cam surface 18 of the control shaft 16 is controlled to be held at the position shown in FIGS. 4 and 5, the rotation of the cam shaft 10 swings only the drive link 28 and the swing cam 30, while the intake valve 20 is kept being closed. Therefore, the peak lift amount becomes zero in the variable lift control executed when the support shaft 38 is at the positions shown in FIGS. 4 and 5.

In the variable lift control, if the control shaft 16 is controlled so that the position of the third cam surface 18 is located at the intermediate position between the position of the angle ◘1 (the states shown in FIGS. 1 and 3) and the position of the angle ◘2 (the states shown in FIGS. 4 and 5), the peak lift amount of the intake valve 20 becomes an intermediate lift amount between the lift amount shown in FIG. 3 and the lift amount shown in FIG. 5. Thus, changing the rotational phase of the control shaft 16 can continuously vary the peak lift amount of the intake valve 20.

As shown in FIGS. 4 and 5, in a region where the third cam surface 18 is located at a position between the angle zero (corresponding to the stationary surface 12*a*) and the angle ◘2, the peak lift amount becomes to be the maximum one when the top portion 10*b* of the first cam surface 10*a* is located at a position between the angle zero and the angle ◘2.

Although the lift amount of the intake valve 20 is set to be zero in this embodiment, the rotational phase of the top portion 10*b* can change from the angle ◘1 to the angle ◘2. This changing amount between the angle ◘1 and the angle ◘2 continuously varies according to the rotational phase of the control shaft 16, similarly to the peak lift amount described above. That is, the rotational phase of the top portion 10*b* moves in a direction reverse to the rotational direction of the cam shaft 10 as the peak lift amount becomes smaller. In other words, the timing of the intake valve 20 becomes faster as the peak lift amount becomes smaller. These features are shown in FIG. 8.

Figure 8:
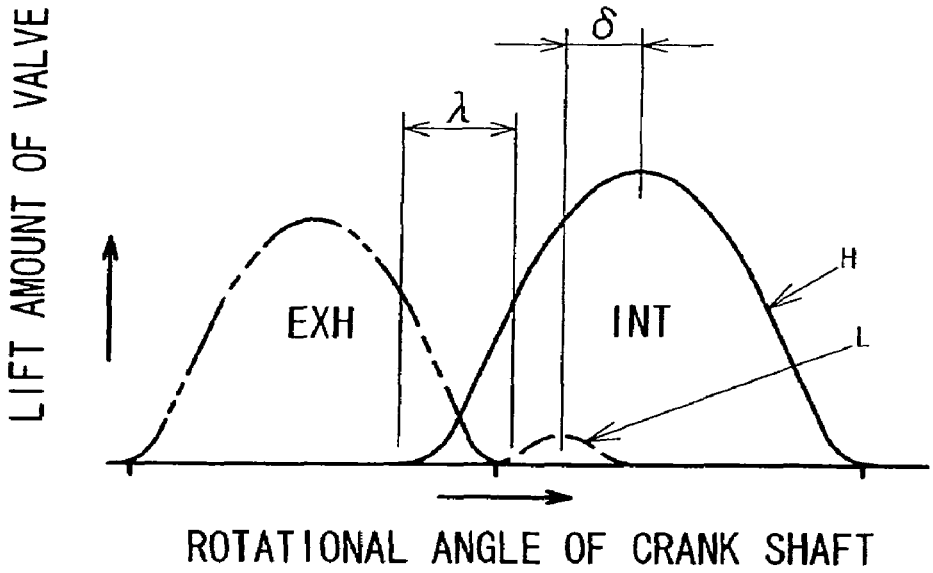
FIG. 8 is a diagram showing opening valve characteristics, between a rotation angle of a crank shaft and a lift amount of a valve when the variable valve timing device shown in FIG. 1 is operated.

FIG. 8 shows valve-open characteristics, including a characteristic in a case where the peak lift amount is the maximum one as shown in FIGS. 1 and 3, and a characteristic in a case where the rotational phase of the control shaft 16 is somewhat smaller than the angle ◘2 shown in FIG. 4, that is, the peak lift amount is very small. In FIG. 8, a horizontal axis indicates a rotational angle of the crank shaft of the internal combustion engine, which corresponds to the rotational phase (the rotational angle) of the cam shaft 10. The rotation of the cam shaft 10 is illustrated so that it moves from a left side toward a right side in FIG. 8. A vertical axis indicates a lift amount of the intake valve 20.

A line H indicates the maximum peak lift amount of the intake valve 20, and a broken line L indicates its smaller lift amount. In addition, in FIG. 8, the above-described mechanism and control of the intake valve 20 are not adapted for an exhaust valve in this embodiment, and accordingly a lift amount of the exhaust valve becomes a chain double-dashed line.

FIG. 8 shows that the timing of the peak lift is earlier by time of ◘relative to the rotational phase of the cam shaft 10, moving by time ◘toward the left side in FIG. 8, as the peak lift amount becomes smaller.

When the peak lift amount of the intake valve 20 is the maximum one, the lifts of the intake valve 20 and the exhaust valve are overlapped with each other, causing an overlapped period indicated by the crank angle ◘. Thus, the overlapped period decreases as the peak lift amount becomes smaller.

The variable valve timing device of the first embodiment can vary the valve-open timing according to the peak lift amount without using an additional special device for varying the timing of the valve. Accordingly, this variable valve timing device can be built by a simple structure, and can provide valve-open characteristics that can meet a need of an international combustion engine, decreasing its weight and manufacturing costs.

Incidentally, the valve-open timing characteristics are variable by changing geometric arrangement or layout of the cam shaft 10, the first roller 26, the second roller 34, the third roller 36, the third cam surface 18 and the support shaft 38.

The drive link 28 and the swing cam 30 constituting main parts of the variable valve timing device of the first embodiment is manufactured as follows.

The drive link 28 can be manufactured by using a normal press process and a caulking process, since it is obtained by sandwiching the swing cam 30 and the connecting pin 32, the second roller 34 and the third roller 36 between two plates 28*a* and 28*b*. The swing cam 30 can be obtained by punching out a steel plate to form it in a press process such as fine-blanking. They can be manufactured at low manufacturing costs because of using normal manufacturing processes described above.

Next, a variable valve timing device, of a second embodiment according to the present invention, adapted for an internal combustion engine will be described with reference to the accompanying drawing of FIG. 6.

Figure 6:
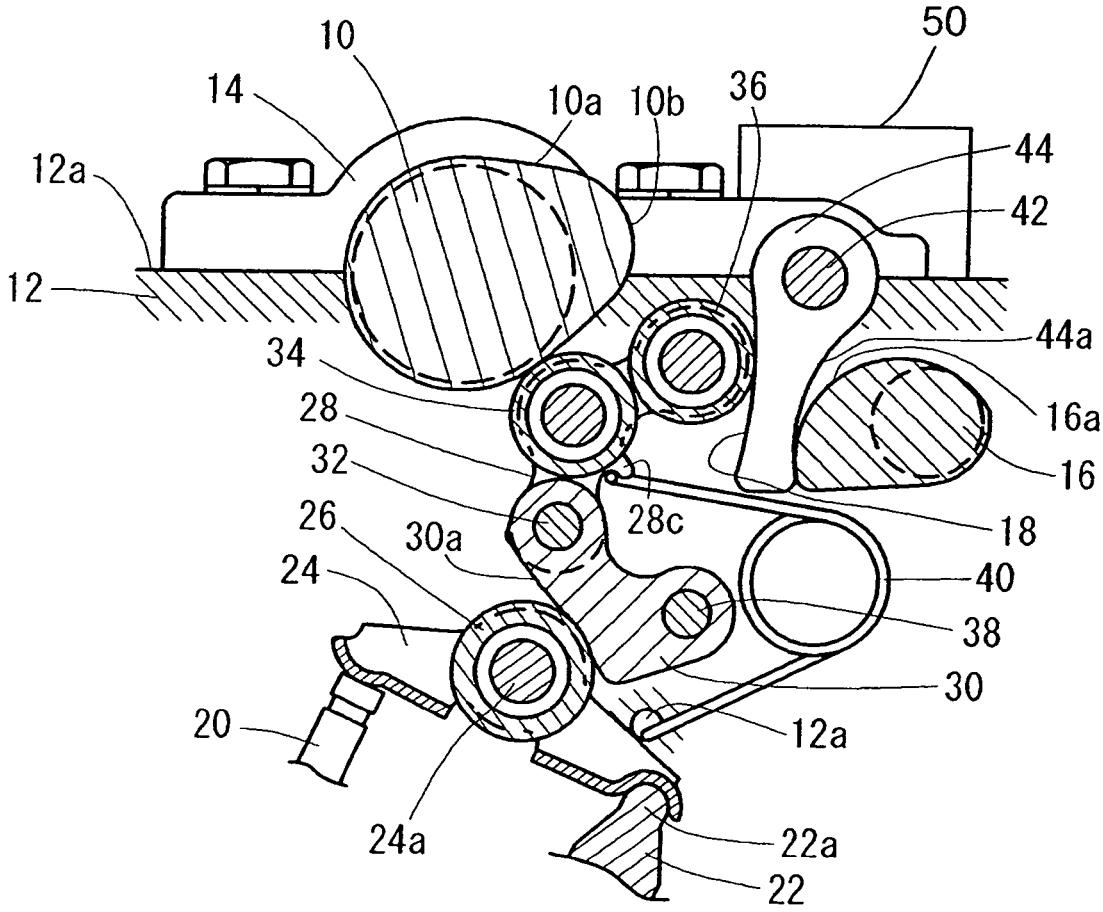
FIG. 6 is a cross-sectional view showing a variable valve timing device of a second embodiment according to the present invention.

FIG. 6 corresponds to FIG. 1, although relationships between a control shaft 16 and a third cam surface 18 are different from each other between the second embodiment and the first embodiment.

In the second embodiment, the third cam surface 18 is formed on a control cam 44 swingably supported by a second support shaft 42, which is fixed on a cylinder head 12. A back-side surface 44*a* of the control cam 44 is pressed by a fourth cam surface 16*a* of the control shaft 16. Accordingly, a position of the third cam surface 18 can vary according to rotation of the control shaft 16 similarly to the first embodiment.

The operation of the variable valve timing device of the second embodiment is similar to that of the first embodiment except how to move the third surface 18, and its description is omitted. Therefore, the variable valve timing device of the second embodiment can vary valve-open timing according to a peak lift amount without using an additional special device for advancing the valve-open timing.

In the second embodiment, the relationship between a rotational angle of the control shaft 16 and a swing angle, corresponding to a moving amount, of the third cam surface 18 can be set arbitrarily by changing the profile of the control cam 16*a*. This enables the control shaft 16 to be driven by smaller drive-torque, and thereby output of an actuator 50 thereof can be smaller.

Although the variable valve timing device is adapted only for the intake valve 20 in the embodiments, it is adaptable for an exhaust valve to vary its lift amount and valve-timing.

As described above in the embodiments, the variable valve timing device of the invention has a variable lift function for changing valve lift-amount and a variable valve-timing function for varying the valve-timing and peak-lift timing at the same time.

One variable valve timing device is used for one valve in the embodiments, while one third cam surface 13 and one set of the drive link 28 and the swing cam 30 can be used for a plurality of valves.

In a case where one cylinder is provided with two valves, the third cam surface 18 can be set to have different profiles for moving the valves, respectively. Therefore, when the internal engine is operated at low load, where the peak lift amount is small, the valves can be controlled so that one of the valves is kept closed and the other of them is kept in a small lift amount. This is desirable for an internal combustion engine adapted for a motor vehicle in order to improve its fuel consumption efficiency and exhaust-gas purification efficiency.

While there have been particularly shown and described with reference to preferred embodiments thereof, it will be understood that various modifications may be made therein, and it is intended to cover in the appended claims all such modifications as fall within the true spirit and scope of the invention.

The first cam surface 10 and the third cam surface 18 may be formed to have a desirable cam profile different from those of the embodiments, and/or a desirable control characteristic according to an operation of an internal combustion engine.

The entire contents of Japanese Patent Application No. 2005-341370 filed Nov. 28, 2005 are incorporated herein by reference.

What is claimed is:

1. A variable valve timing device adapted for an internal combustion engine comprising:

a first roller;

a second roller;

a connecting pin;

a support shaft provided on a stationary member;

a cam shaft formed thereon with a first cam surface;

a rocker arm rotatably supporting the first roller and enabling a valve to be opened by a swing movement of the rocker arm when the first roller is pressed;

a drive link rotatably supporting the second roller and moving to drive the connecting pin when the second roller is pressed by the first cam surface;

a swing cam formed thereon with a second cam surface, the swing cam being swingable at a center of the support shaft, when the swing cam is pressed by the drive link through the connecting pin, so that the second cam surface presses the first roller; and an actuator for changing a position of a third cam surface to vary a position of the drive link.

2. The variable valve timing device according to claim 1, wherein a contact position between the second roller and the first cam surface of the cam shaft moves in a direction opposite to a rotational direction of the cam shaft when the third cam surface is moved in a direction where a maximum lift amount of the valve becomes smaller.

3. The variable valve timing device according to claim 2, wherein the drive link rotatably supports a third roller, and the third roller is in contact with the third cam surface.

4. The variable valve timing device according to claim 3, wherein the third cam surface is formed to have a circular-arc surface.

5. The variable valve timing device according to claim 4, wherein the third cam surface is provided with the control shaft.

6. The variable valve timing device according to claim 4, wherein the third cam surface is formed on the control cam which is arranged between the drive link and the control shaft and is movable by the control shaft.

7. The variable valve timing device according to claim 1, wherein the drive link rotatably supports a third roller, and the third roller is in contact with the third cam surface.

8. The variable valve timing device according to claim 7, wherein the third cam surface is formed to have a circular-arc surface.

9. The variable valve timing device according to claim 8, wherein the third cam surface is provided with the control shaft.

10. The variable valve timing device according to claim 8, wherein the third cam surface is formed on the control cam which is arranged between the drive link and the control shaft and is movable by the control shaft.

11. The variable valve timing device according to claim 1, wherein the third cam surface is formed to have a circular-arc surface.

12. The variable valve timing device according to claim 11, wherein the third cam surface is provided with the control shaft.

13. The variable valve timing device according to claim 11, wherein the third cam surface is formed on the control cam which is arranged between the drive link and the control shaft and is movable by the control shaft.

14. The variable valve timing device according to claim 1, wherein the third cam surface is provided with the control shaft.

15. The variable valve timing device according to claim 1, wherein the third cam surface is formed on the control cam which is arranged between the drive link and the control shaft and is movable by the control shaft.

* * * * *